US005845923A

United States Patent [19]

Zanco

[11] Patent Number: 5,845,923

[45] Date of Patent: Dec. 8, 1998

[54] DEVICE FOR RAISING A SKI BINDING AND SKI EQUIPPED WITH SUCH A DEVICE

[75] Inventor: Alain Zanco, Saint Nicolas de Macherin, France

[73] Assignee: Skis Rossignol S.A., France

[21] Appl. No.: 649,139

[22] Filed: May 14, 1996

[30] Foreign Application Priority Data

May 17, 1995 [FR] France ..... 95 06077

[51] Int. Cl.[6] ..... A63L 5/06

[52] U.S. Cl. ..... 280/607; 280/602

[58] Field of Search ..... 280/607, 609, 280/11.14, 11.15, 617, 636, 602, 618, 620

[56] References Cited

U.S. PATENT DOCUMENTS

| | | | |
|---|---|---|---|
| 3,260,532 | 7/1966 | Heaxel . | |
| 4,678,200 | 7/1987 | Powell | 280/607 |
| 4,725,069 | 2/1988 | Stampacchia et al. | 280/607 |
| 5,046,751 | 9/1991 | Scherubl | 280/617 X |
| 5,129,668 | 7/1992 | Hecht | 280/607 |
| 5,470,094 | 11/1995 | Commier et al. | 280/602 |
| 5,647,605 | 7/1997 | Arduin | 280/602 |

FOREIGN PATENT DOCUMENTS

| | | | |
|---|---|---|---|
| 0510308 | 2/1992 | European Pat. Off. . | |
| 469452 | 2/1992 | European Pat. Off. | 280/607 |
| 2686799 | 8/1993 | France . | |
| 2690078 | 10/1993 | France . | |
| 4100327 | 7/1991 | Germany | 280/607 |
| 9507737 | 3/1995 | WIPO | 280/602 |

*Primary Examiner*—Mark T. Le
*Assistant Examiner*—Tyrone M. Lee
*Attorney, Agent, or Firm*—Wall Marjama Bilinski & Burr

[57] ABSTRACT

A raising device (1) intended to be placed in the support region (3) of a ski and to accommodate a safety binding formed at the front by a toe piece (15) and at the rear by a heel piece (16), said device being composed of two opposing arms (3, 4) extending in regions having an overlap along the longitudinal direction of the ski, each of the arms (3, 4) having a bearing point (7, 8) located on the ski, wherein each of the arms has a floating end which is raised relative to the upper face of the ski and is connected to the ski solely by a viscoelastic block (5, 6), these two blocks being equipped on their upper face with a metal platform (17, 18) capable of accommodating respectively the toe piece (15) and the heel piece (16), the fixed bearing points and the floating ends of the arms being opposite one another.

13 Claims, 11 Drawing Sheets

1
2
3
4
5
6
7
8
13
14
15
16
17
18
II
II'
III
III'
IV
IV'

DEVICE FOR RAISING A SKI BINDING AND SKI EQUIPPED WITH SUCH A DEVICE

TECHNICAL FIELD

The invention applies to the field of skis, and more precisely alpine skis. It constitutes an improvement to the binding device.

PRIOR ART

The problem of vibration damping is well known in the field of skiing. It is known that skiing over rough snow generates oscillations in the beam forming the ski. These oscillations may prove to be detrimental because they cause localized unweighting of the ski, and therefore losses of support. It is therefore necessary to limit the amplitude of these oscillations as far as possible, while ensuring that the ski retains good dynamic stiffness.

The problem arises more particularly in the support region and, more precisely, around the binding because this is the main region where forces are transferred.

Documents FR-2 690 078 and FR-2 686 799, describe articulated devices making it possible to modify the distribution of the pressure of the ski on the snow. The proposed mechanisms use sets of connecting rods to convert the vertical movements of the boot into horizontal movements of an arm which floats elastically on the top of the ski so as, on the one hand, to exert a force which resists flexing of the ski and, on the other hand, to absorb some of the deformation energy, and thus to damp the vibrations.

Although effective, these systems do not solve a second related problem encountered at the binding when the ski bends. This is an effect of clamping or stiffening of the support region of the ski, as the ski flexes.

In general, the bindings actually consist of two parts, namely a toe piece at the front and a heel piece at the rear. The boot sole which is gripped between these two pieces is generally solid and nondeformable. Thus, when the ski bends, that is to say when the ski curves in a vertical longitudinal plane, the toe piece and the heel piece tend to move toward each other. By virtue of the rigidity of the boot sole, this leads to forces being exerted on the toe piece and the heel piece, respectively forward and backward. On the one hand, these forces affect the tension of the springs of the binding and alter its settings. On the other hand, these extraneous forces oppose the deformation of the ski and therefore alter its behavior.

Document WO 95/07737 describes a device which functions by the longitudinal sliding of two metal plates which support the toe piece and the heel piece. In theory, the upper ends of each plate are assumed to move apart when the ski bends, which would provide some degree of unclamping of the ski.

However, in the architecture which is described the upper ends slide over the opposite ends with metal against metal friction. It is clear that such friction impairs the sliding and therefore the unclamping of the ski. Such an architecture also involves significant risks of jamming due to ice. Further, and above all, such a device is limited to longitudinal sliding and does not permit any damping of vertical impacts because the platforms supporting the toe piece and the heel piece have no capacity for vertical movement.

It has further been proposed, in particular in document U.S. Pat. No. 3,260,532, to fit the binding on a rigid plate, itself raised relative to the board to which it is connected by its two ends. In order to dampen vibrations, the space between the plate and the board is filled with a damping material. The advantage of this device is that it absorbs some of the energy due to the deformation of the ski.

However, because of its rigidity, it increases the overall stiffness of the ski and alters its dynamic behavior.

DESCRIPTION OF THE INVENTION

The object of the invention is to provide a plate for raising the bindings on a ski, allowing good vibration damping at the binding while avoiding the appearance of detrimental stresses, in particular when the ski bends.

The invention relates to a raising device intended to be placed in the support region of a ski and to accommodate a safety binding formed at the front by a toe piece and at the rear by a heel piece.

This raising device is composed of two opposing arms extending in regions having an overlap along the longitudinal direction of the ski, each of the arms having a bearing point located on the ski. This raising device is one in which each of the arms has a floating end which is raised relative to the upper face of the ski and is connected to the ski solely by a visco-elastic block, these two blocks being equipped on their upper face with a platform capable of accommodating respectively the toe piece and the heel piece, the fixed bearing points and the floating ends of the arms being opposite one another.

The term "floating" end is intended to mean one which can move in translation relative to the upper surface of the ski. A floating or free end therefore has a capacity for movement, either directly or inside an intermediate component arranged on the ski.

The floating ends of the arms thus have freedom to move downward by compression of the viscoelastic blocks. In contrast to the prior art corresponding to Document WO 95/07737, this permits a capacity for absorbing vertical impacts.

By virtue of this arrangement, and in contrast to the prior art cited above, under the effect of the ski flexing, the bearing points of each of the arms move toward one another relative to their rest position, while pushing back and therefore separating their floating ends. The effect of this is to prevent the distance between the toe piece and the heel piece being decreased, the resulting deformation being absorbed by the viscoelastic blocks working in shear mode and in compression mode.

The invention therefore consists in giving the toe piece and the heel piece some capacity to move relative to the board by virtue of the elastic blocks, and to subordinate these movements to the deformation of a quadrilateral which allows a slight separation of the two elements of the binding. The behavior of the board is in this way decoupled from the rigidity of the boot/binding assembly. This arrangement allows the board to retain its theoretical dynamic behavior, in particular in order to take into account the optimum flexion and elasticity characteristics of the materials used in high-performance boards.

There are various ways of adhering to the essential geometry of the invention.

In a first embodiment, the two arms are rods placed side by side along the longitudinal direction of the ski, and the free end of each rod is connected to the corresponding viscoelastic block, while the bearing point on the ski for each rod consists of a fork joint, fixed on the ski and articulated to the other end of the rod.

In an alternative embodiment, the viscoelastic blocks consist of two superposed portions, namely a lower portion having capacities for working in shear mode and an upper portion having capacities for working in compression mode. This double construction makes it possible to optimize the reaction of the viscoelastic block to the deformations which take place during flexing. Specifically, during bending the blocks are subjected simultaneously to displacement and compression. In order to take this double phenomenon into account, it proves beneficial to use materials having optimum qualities for each type of deformation, rather than to employ materials with average behavior.

According to one design variant, the end of at least one of the rods is extended by a plate parallel to the upper face of the ski, which plate is embedded inside the corresponding viscoelastic block. This arrangement makes it possible to solve the problem of deformations of the elastic block in lateral directions, which generate inaccuracies and wavering in the guidance of the ski.

This variant may advantageously be combined with the preceding variant by using the aforementioned plate to separate the two viscoelastic regions.

In order to keep the direction of the displacements of each element of the device positively in a plane perpendicular to the surface of the ski and parallel to the longitudinal axis of said ski, this device may be equipped with guide means capable of preventing the displacement of the rods and of the blocks in directions transverse to the ski. These means may be formed by a guide finger interacting with a slot in the binding support platform, or alternatively by plates for guiding the rods. The accuracy of the device is thus promoted by transversely guiding at least one of the floating ends corresponding to the binding support.

According to a second embodiment architecture, each arm includes three flat and straight sections, respectively a top section, an inclined intermediate section and a bottom section, the top section constituting the platform for accommodating the toe piece or the heel piece, the bottom section constituting the point for bearing on the ski and the intermediate section being inclined and connecting the top and bottom sections.

Put another way, in this variant the arms are in the form of intercrossed bent plates.

In other words, in one of the possible geometries, the heel piece is mounted at the rear end of a first arm whose front end is secured to the board close to the front of the binding, while symmetrically the toe piece is mounted at the front end of a second arm whose rear end is secured to the board close to the rear of the binding. The rear end of the first arm and the front end of the second arm are connected to the board, directly or indirectly, by viscoelastic blocks which permit a relative movement of these ends with respect to the board as the latter deforms.

In this way, the inclined intermediate portions serve as struts, so that when the ski flexes, the arms move their top ends with respect to their rest positions, while substantially increasing the distance between the toe piece and the heel piece, with the viscoelastic blocks working in shear mode.

More generally, the invention consists in maintaining, as the ski bends, at least a substantially constant separation, or even in slightly increasing it, between the toe piece and the heel piece by virtue of two rigid arms, and in absorbing some of the deformation energy by virtue of the shearing and compression of the viscoelastic blocks. These various phenomena are thus intimately combined in order to achieve an effective result.

As regards the location of the bearing points on the ski, the bottom section of at least one of the two arms is secured to the ski either below the adjacent viscoelastic block or level with the sides, or alternatively in front of the toe piece or in back of the heel piece. Quite clearly, as the separation between the bearing points increases, the lever arms increase and therefore the toe piece and the heel piece tend to move apart to a greater extent as the ski bends.

In view of the fact that operation involves deformation, and in order to overcome the stiffness phenomena inherent in the use of a monolithic arm, the arm may be made of three sections articulated to one another. The device thus has an additional degree of freedom, making it possible to adapt the mutual inclination of the sections to the curvature of the freedom, making it possible to adapt the mutual inclination of the sections to the curvature of the ski, while retaining the function of the intermediate section as a strut of constant length.

In one practical embodiment, permitting lateral overlap of the two rigid plates, the intermediate section of each arm has a complementary portion of reduced width intended to permit intercrossing of the two arms.

In another embodiment, the intermediate section of one of the arms has a recess at its center, and the intermediate section of the other arm has a portion of width slightly less than that of the recess, so that this portion can move freely inside the recess.

In practice, the rigid plate is advantageously made of a material belonging to the group comprising lightweight metals, in particular aluminum alloys, laminated composites and rigid plastics.

It is found that good results are obtained if the material forming the viscoelastic block has an intrinsic damping coefficient (tan $\delta$) of between 0.4 and 1.2.

In addition, an assembly which is easy to incorporate into a conventional ski is obtained if each arm has a thickness of between 2 and 10 mm, and if the block of viscoelastic material has a thickness of between 3 and 50 mm.

BRIEF DESCRIPTION OF THE DRAWINGS

The way in which the invention may be embodied, and the advantages which result therefrom will emerge clearly from the following description of embodiments, supported by the appended figures.

EMBODIMENTS OF THE INVENTION

First Embodiment

The raising device (1) according to the invention is fitted in the support region. The support region of the ski (2) is intended to mean the central part of the ski, with a length of approximately 600 millimeters, on which the binding is fitted.

Figure 1:
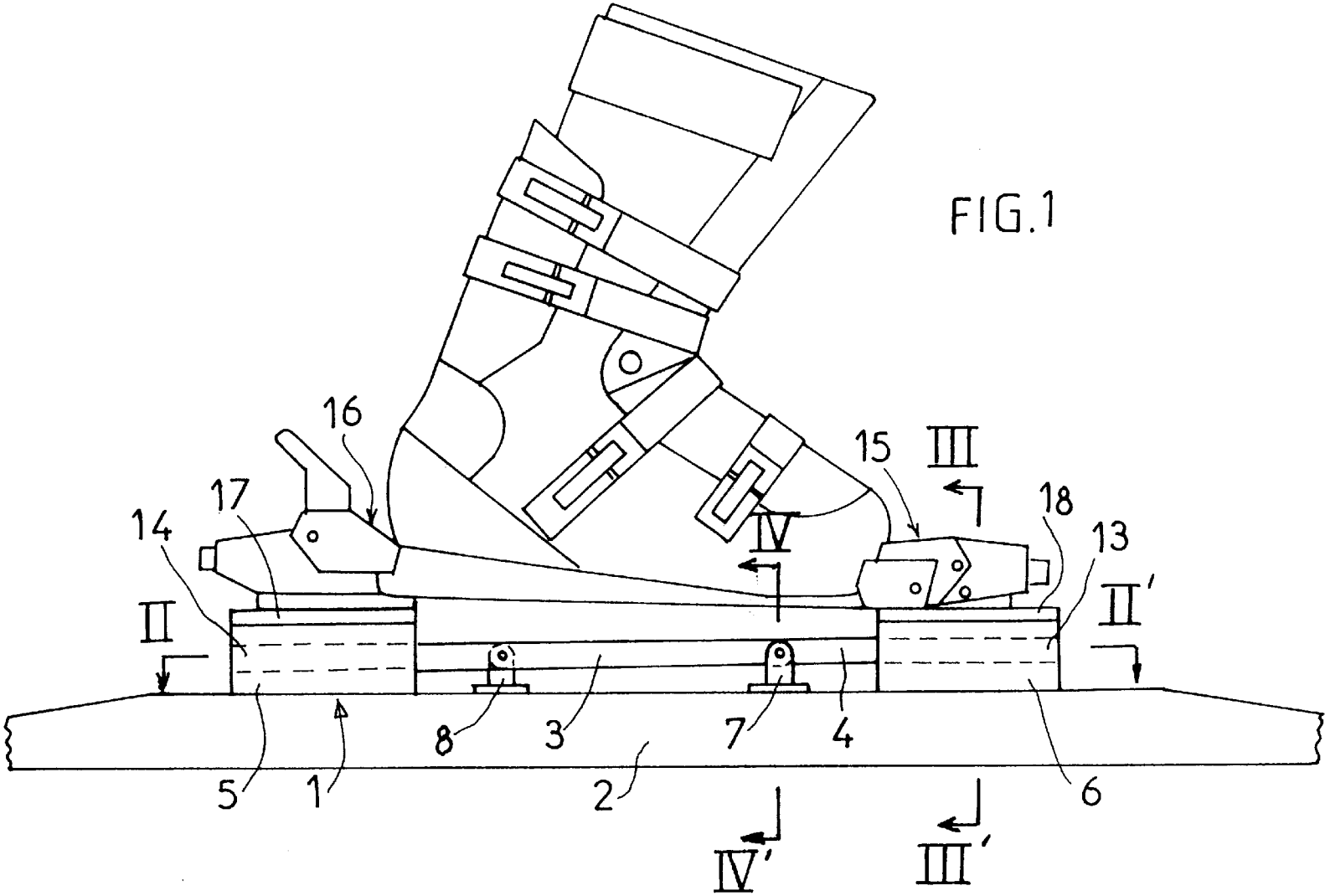
FIG. 1 is a side view of the first embodiment of the invention.

As shown in FIG. 1, the raising device according to a first embodiment has two identical rods (3,4) connected, on the one hand, to the support region (2) and, on the other hand, to a viscoelastic block (5, 6). The use of two subassemblies which differ slightly from one another would not, of course, depart from the scope of the invention.

Figure 2:
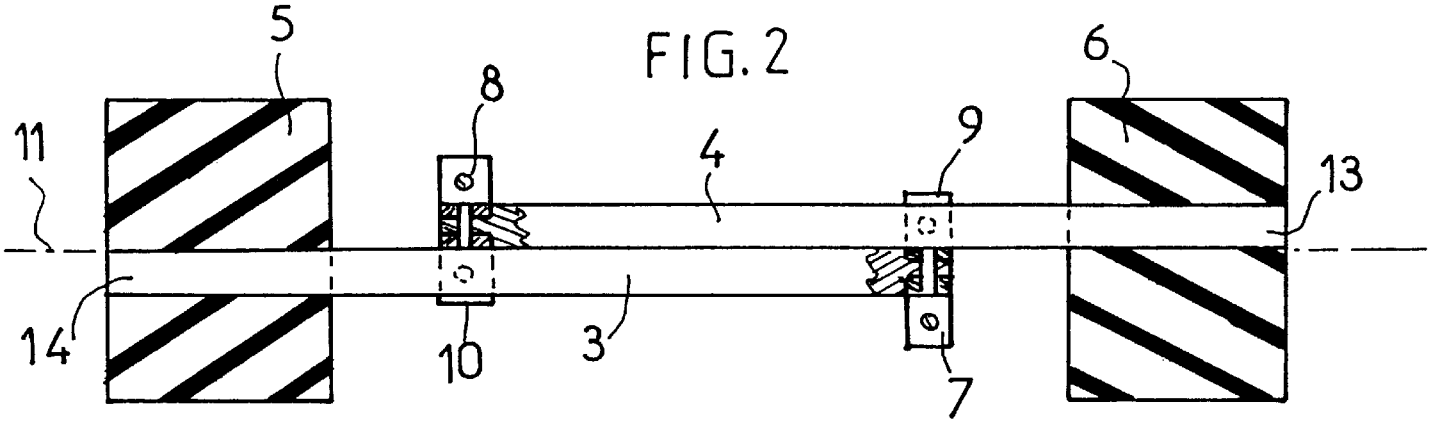
FIGS. 2, 3 and 4 are sectional views, respectively in the planes II–II', III–III' and IV–IV' of FIG. 1.
Figure 4:
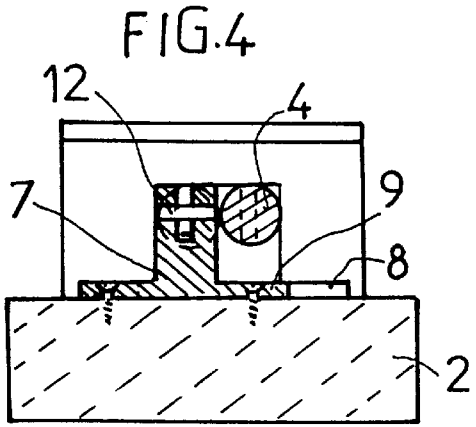
Figure 3:
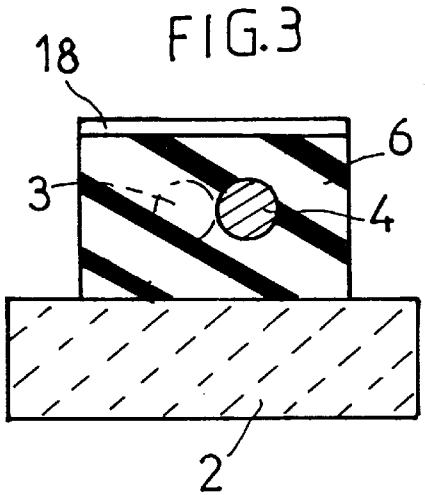

Each rod (3, 4), of cylindrical shape, is connected to the support region by a fork joint (7, 8) whose arrangement is shown clearly in FIGS. 2 and 4. It is obvious that the use of rods which are thinner in order to take into account the constraints on the total thickness of the device would not depart from the scope of the invention. Each fork joint (7, 8) has a flat base (9, 10) which is fixed to the support region by screwing, for example. The front fork joint (7) constitutes the fixed point of the arm whose floating end supports the heel piece, while the rear one (8) constitutes the fixed point of the arm whose floating end supports the toe piece of the binding. In this way, the rods (3, 4) are parallel over a portion of their length and form lever arms of sufficient dimension. In order to permit this juxtaposition, the fork joints (7, 8) are positioned in such a way that they are offset transversely relative to the longitudinal axis (11) of the ski. These fork joints (7, 8) permit articulation of each rod (3, 4) by means of a through-pin (12).

The floating end (13, 14) of each rod (4, 3) penetrates a parallelepipedally shaped block (6, 5) of viscoelastic material which is fitted level with the toe piece (15) and the heel piece (16). The rod (3, 4) passes entirely through the block (5, 6) in order to ensure secure fastening. The upper surface of each block supports a metal plate (17, 18) used as a platform for the binding.

Figure 5:
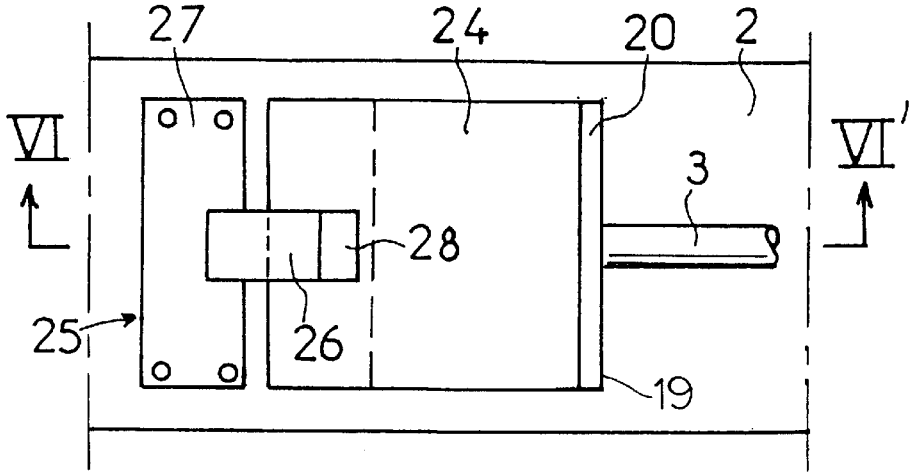
FIG. 5 is a plan view of a viscoelastic block which has a guide finger.
Figure 6:
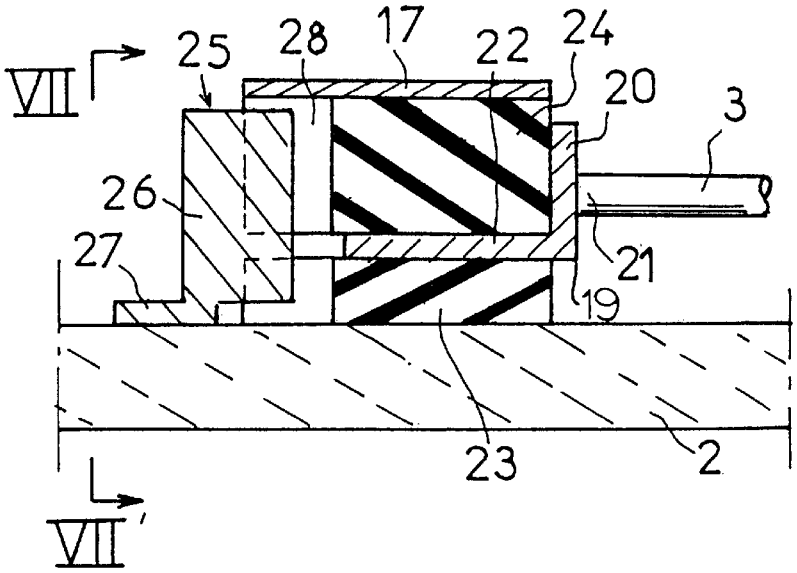
FIG. 6 is a view in section in the plane VI–VI' of FIG. 5.

In a variant illustrated in FIGS. 5 and 6, the rod (3) ends in a plate in the form of a bracket (19). The vertical portion (20) of this bracket is fixed on the end (21) of the cylindrical rod, and the horizontal part (22) penetrates into the viscoelastic block (5). In this way, the surface area for bonding between the arm and the viscoelastic block is larger than in the version described above, which reduces the risks of detachment.

In this case where the viscoelastic block is divided into two parts (23, 24), materials with different qualities can advantageously be used for these two parts, favoring either compression of the top part or shearing of the bottom part.

Figure 7:
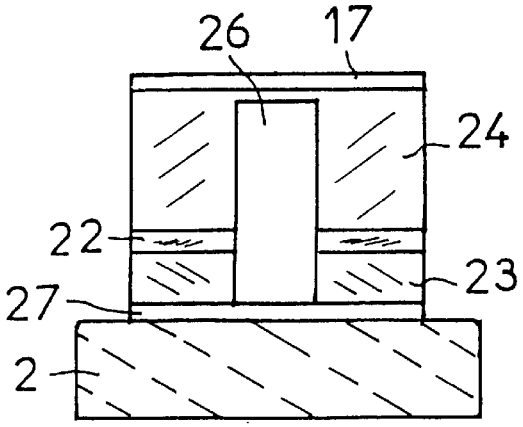
FIG. 7 is a view in section in the plane VII–VII' of FIG. 6.

As illustrated in FIGS. 5, 6, and 7, the viscoelastic block (5) and the associated platform (17) interact with a guide finger (25) fixed on the support region (2). This finger (25) is in the form of a vertical strip (26) oriented along the longitudinal direction of the ski. This strip (26) is secured to the board by a flat screwed base (27). This strip (26) penetrates a complementary slot (28) formed in the platform (17). This slot extends in the viscoelastic block (5) over the entire height of the strip (26). In the case of the variant in FIG. 6, this slot (28) also exists in the horizontal part (22) of the bracket (20), which makes the guiding more rigid. The depth of the slot (28) is calculated so as to take into account the displacement of the strip (26) when the various elements move.

Second Embodiment

Figure 8:
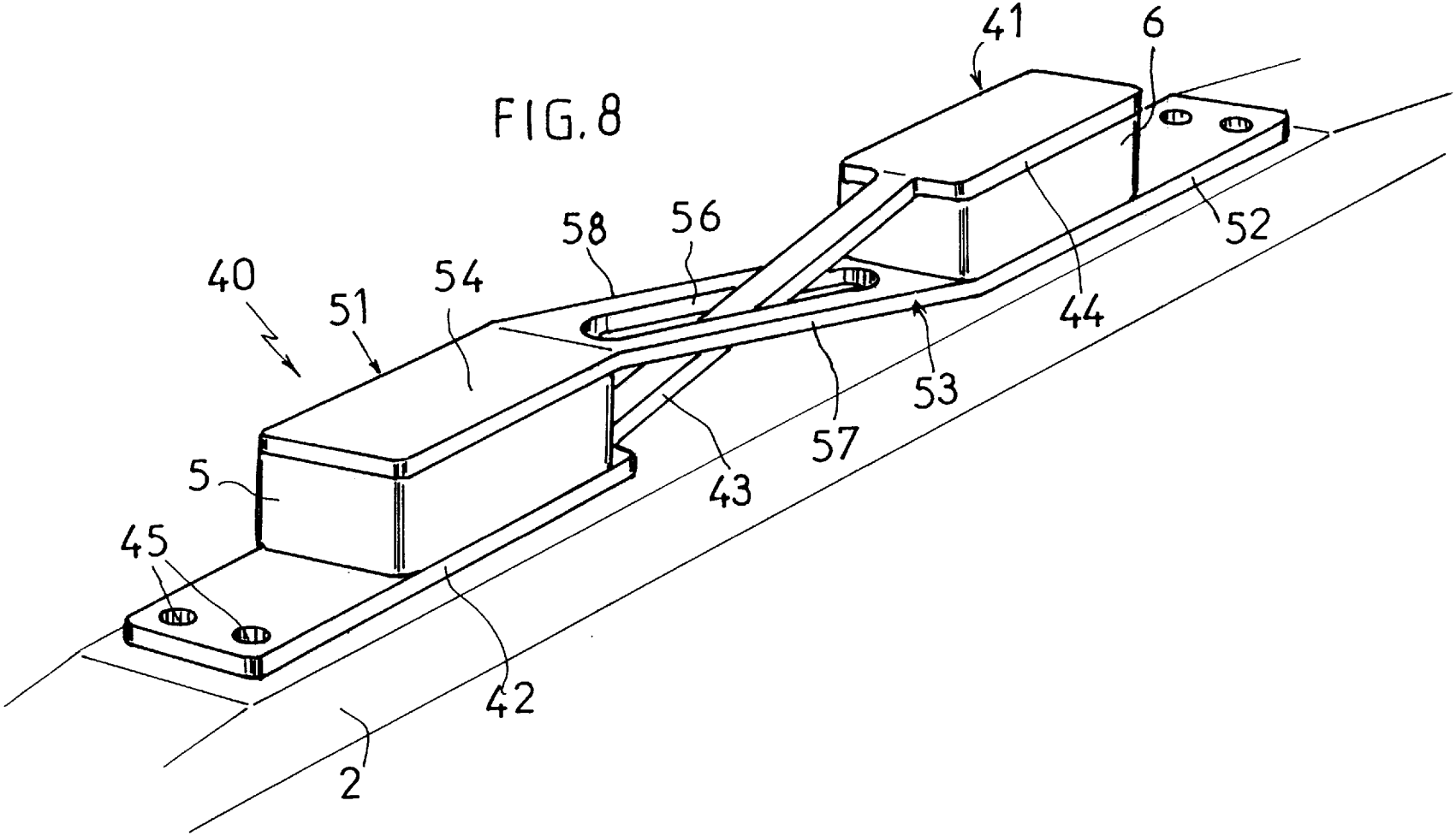
FIG. 8 is a perspective view of a second embodiment of the invention, shown in sectional side view and in plan view respectively in FIGS. 9 and 10.
Figure 9:
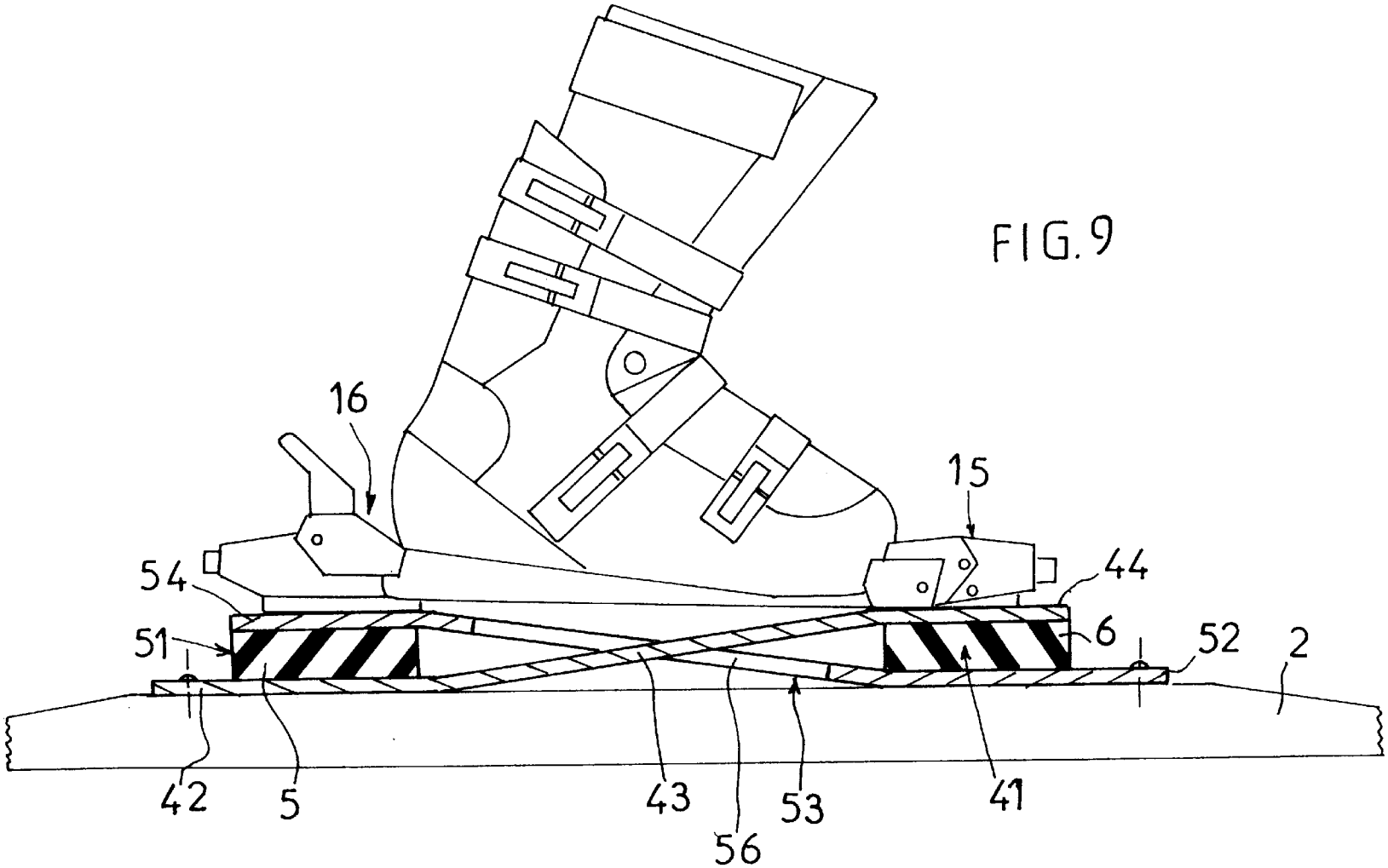
Figure 10:
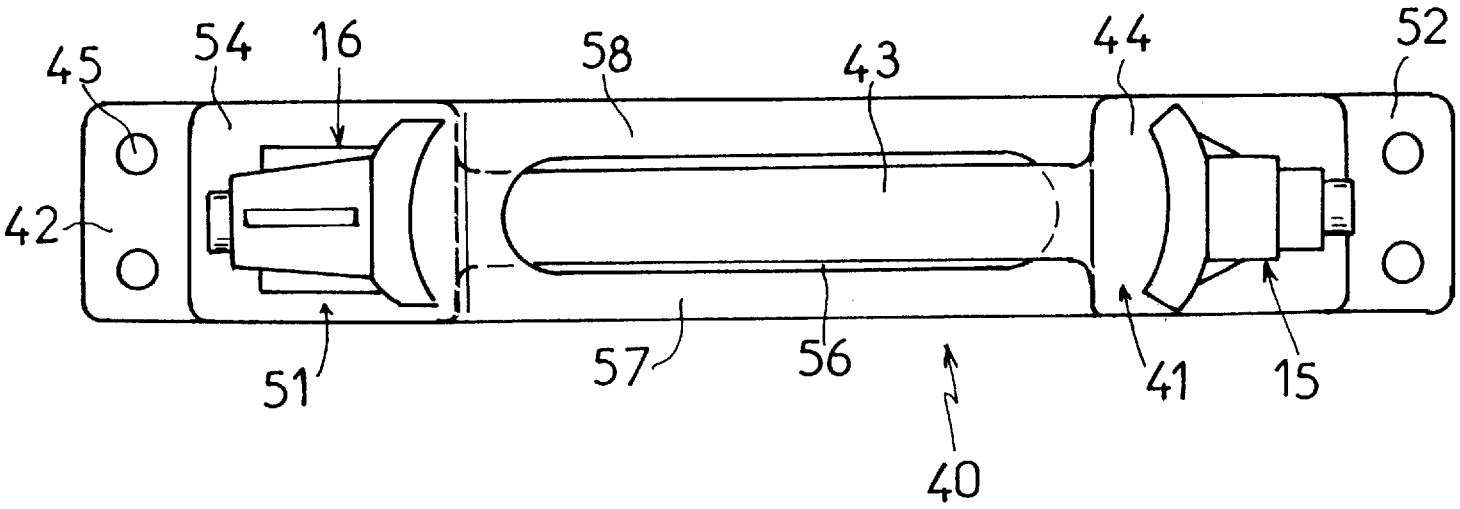

The raising device (40) as illustrated in FIG. 8 may also adopt a different architecture which remains in accordance with the invention.

It consists of two rigid metal arms (41, 51). The first arm (41) has three separate sections (42, 43, 44). The first section (42) is rectangularly shaped and its width is substantially less than that of the ski. It is placed on the top of the ski, level with the heel piece (16) of the binding, using two screws (45). This first section (42) (referred to as the bottom section) is extended toward the front of the ski by a narrower second section (43) centered on the symmetry axis of the ski. This second section (43) forms with the first section (42) an angle which orientates it upward. This second section (43) is itself extended by a rectangular end portion (44) whose width is almost equal to that of the ski but whose length is less than that of the first section (42). This end portion (44) (referred to as the top section) is parallel to the top of the ski and is located in the region of the binding toe piece (15).

The second plate (51) also has three sections (52, 53, 54), and differs from the first plate (41) only as regards its central portion (53). The first section (52) is fixed to the ski (3) level with the toe piece (15) of the binding, below the top section (44) of the first plate (41). It is extended toward the rear of the ski by a central section (53) which has the same width. This central portion (53) is recessed at its center over a large portion of its length. The width of the recess (56) is slightly greater than the width of the central portion (43) of the first plate (41), in order to allow the latter to move freely in translation. In this way, the recess (53) provides lateral guidance of the two arms. In other words, the central part (53) of the second plate (51) is formed by two parallel straight portions (57, 58) which enclose the central part (43) of the first plate (41). The top section (54) of this second plate (51) is placed level with the heel piece (16) of the binding, above the bottom section (42) of the first plate (41).

The top section (44) of the first plate (41) and the bottom section (52) of the second plate (51) are connected by a block (6) of viscoelastic material. The same is true for the opposite end of the raising device (5, 42, 54).

The section (44) of the first plate (41) accommodates the toe piece (15) of the binding, while the top section (54) of the second plate (51) receives the heel piece (16). Clearly, in order to benefit from freedom of movement, the screws for securing the binding do not pass through the entire height of the viscoelastic block and do not touch the upper surface of the ski.

Figure 11:
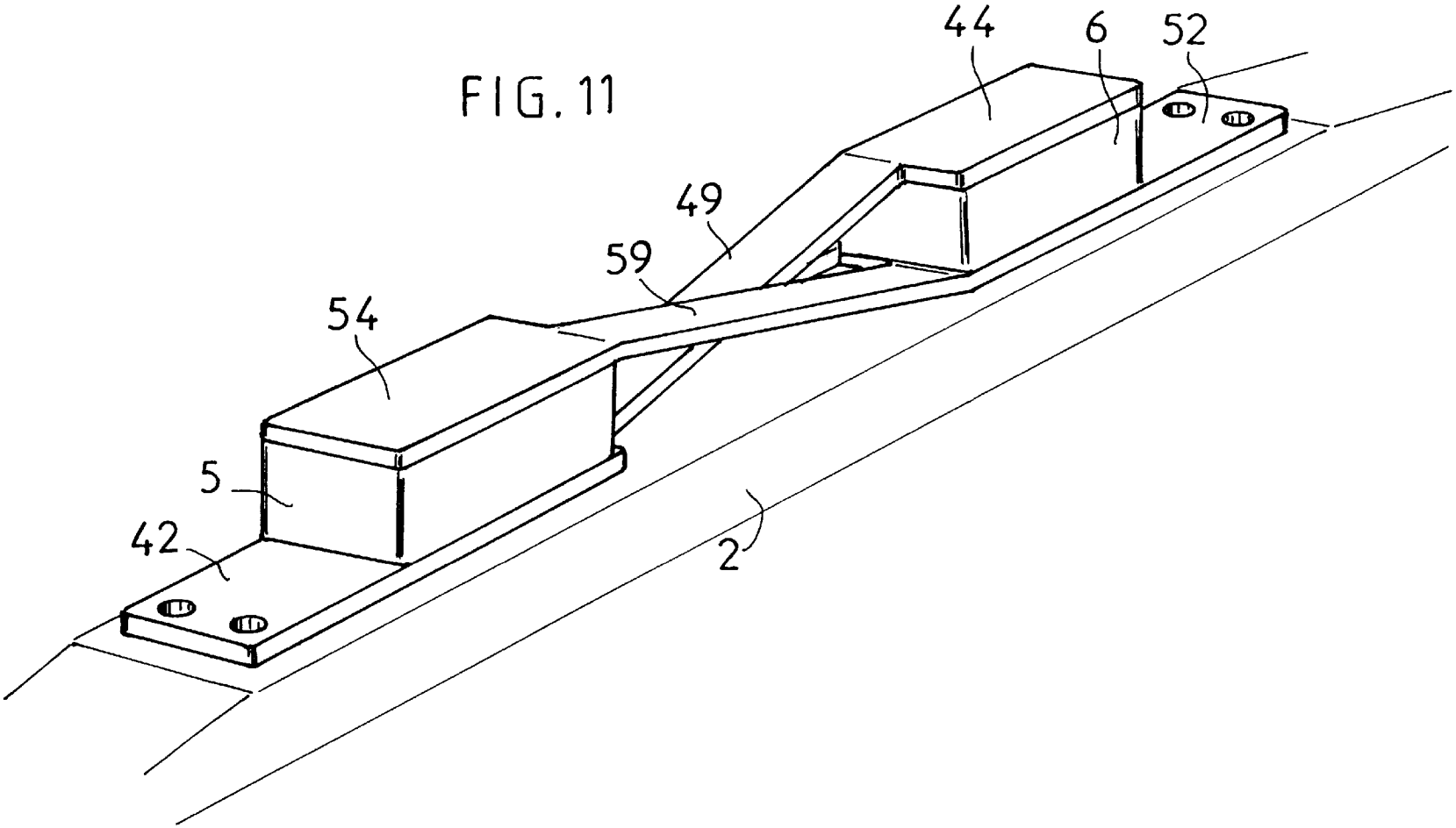
FIG. 11 is a perspective view of an alternative embodiment.

Of course, using a different geometry, such as that illustrated in FIG. 11, making it possible to juxtapose the two central portions (59, 49) would not depart from the scope of the invention.

In order to improve the damping effect for the ski according to the invention, a joint of viscoelastic material may be arranged between the two intermediate sections (43, 53, 49, 59), the effect of which joint, when the ski flexes and therefore when each of these sections moves relative to one another, is to hold firm then to shear, thus providing a reinforcement of the damping effect.

Figure 15:
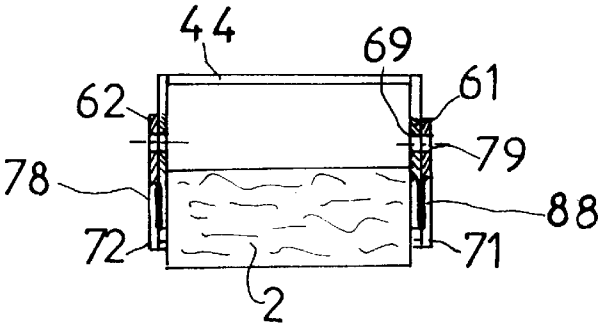
FIG. 15 is a cross-sectional view of the same device, in a vertical plane denoted by the arrows XV–XV' in FIG. 14.
Figure 16:
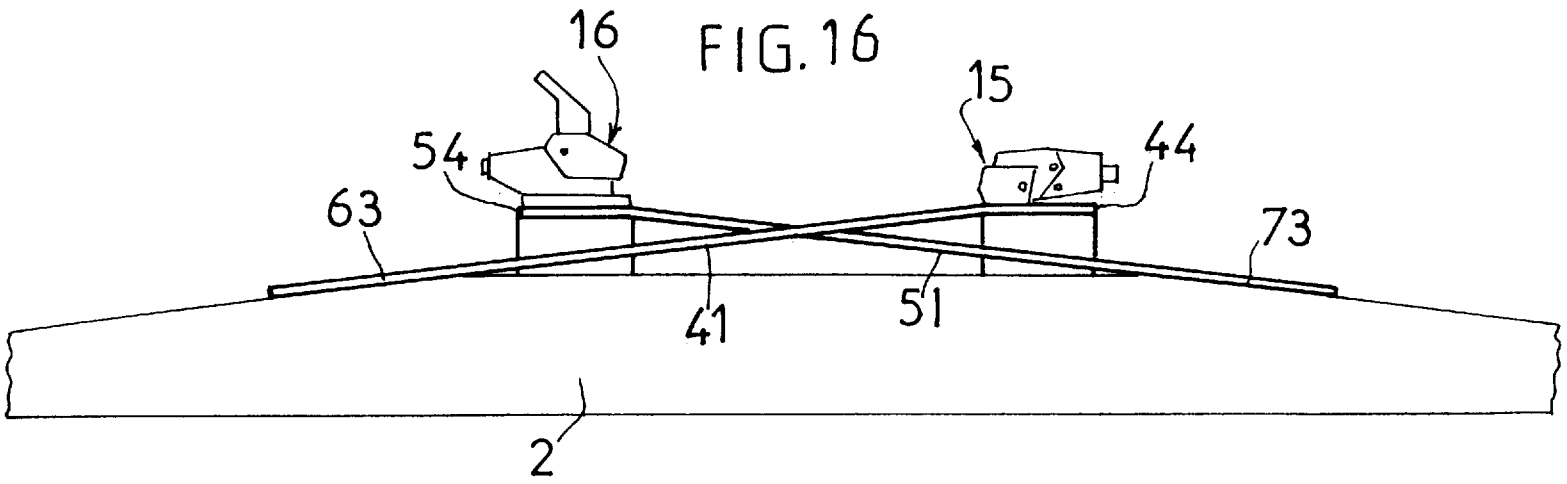
FIG. 16 is a side view of a device in which the bottom sections are fixed outside the binding region.

As regards the geometry of the assembly, the invention also encompasses those variants which use arms bearing on the board either level with the sides (see FIGS. 14 and 15) or alternatively in regions outside the space contained between the toe piece and the heel piece (see FIG. 16).

Figure 14:
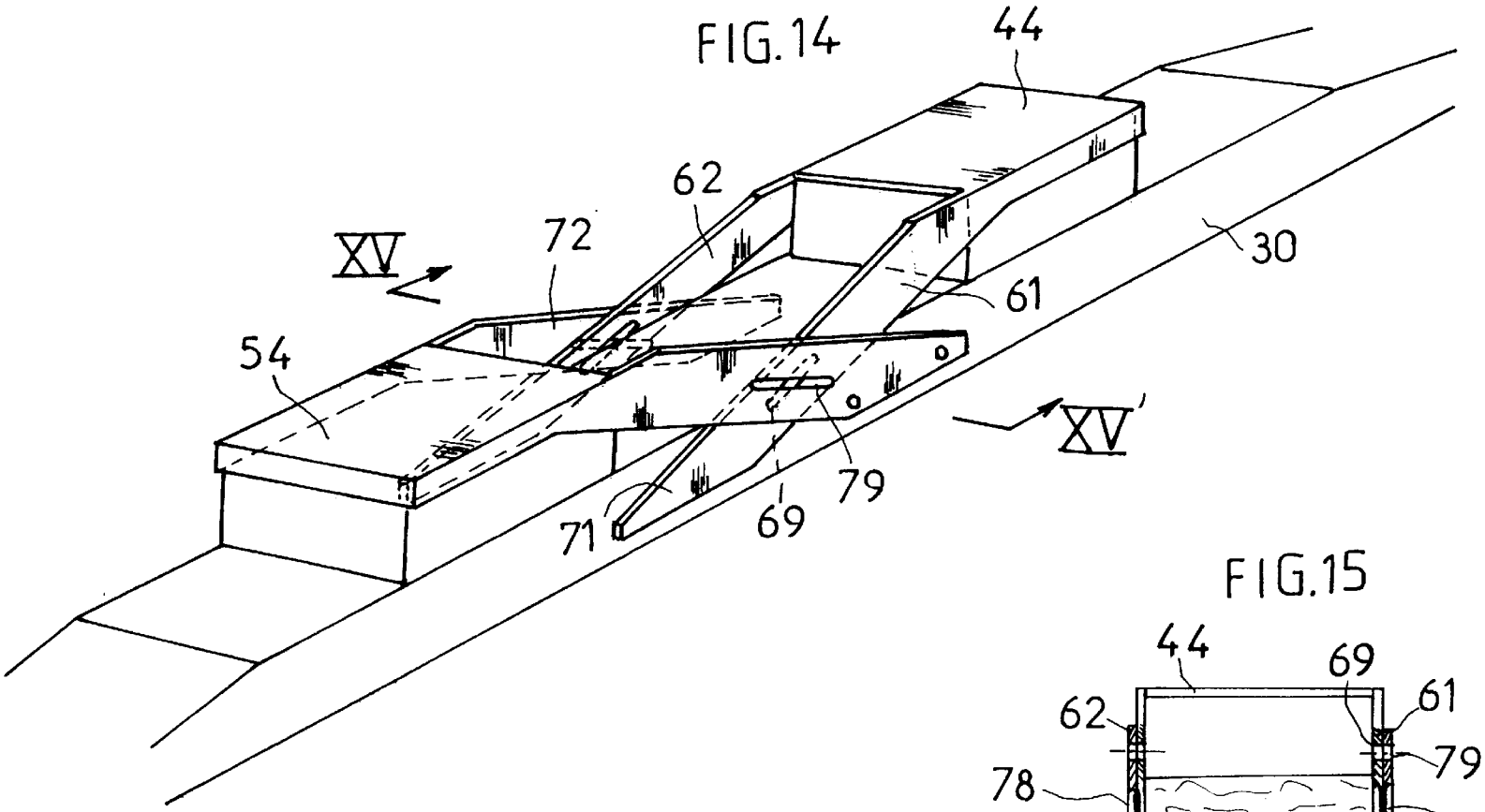
FIG. 14 is an outline perspective view of a device according to the invention, in which the bottom sections are fixed on the sides of the ski.

Thus, as shown by FIG. 14, the intermediate sections may consist of plane plates (61, 62, 71, 72) extending from the top sections (44, 54) and contained in planes parallel to the sides of the ski. The lower part of these plates, constituting the lower sections of the arms, are attached to the support region (3) at the sides (30).

Similarly, as illustrated in FIG. 16, the bottom sections (73, 63) of each of the arms can bear on the board, respectively in front of the toe piece (15) and in back of the heel piece (16).

Figure 13:
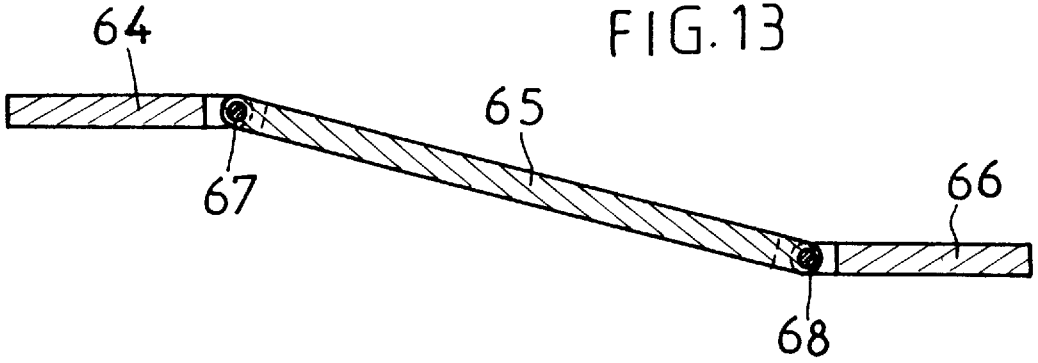
FIGS. 12 and 13 are respectively a plan view and a sectional view of an articulated arm, in the plane XIII–XIII' of FIG. 12.
Figure 12:
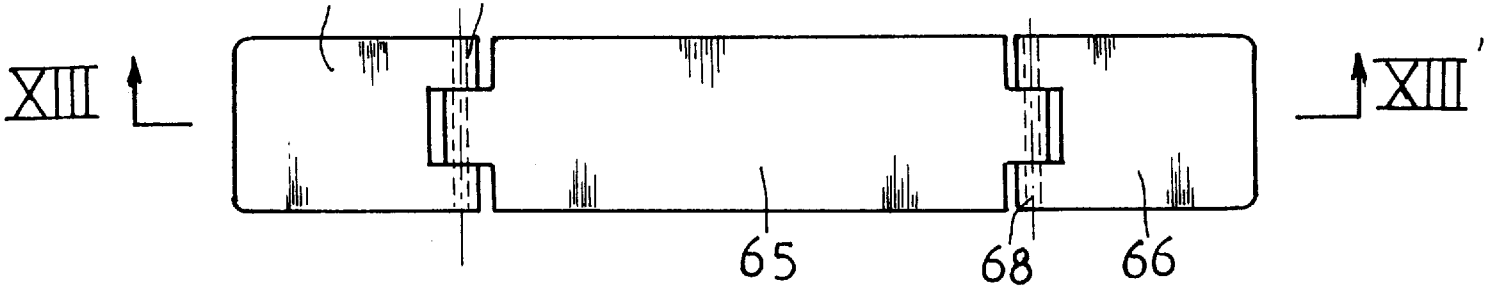

Of course, as already mentioned, all these geometries may advantageously incorporate articulation pins (67, 68) between the various sections (64, 65, 66) (see FIGS. 12 and 13).

Mode of Operation of the Raising Device

Figure 17:
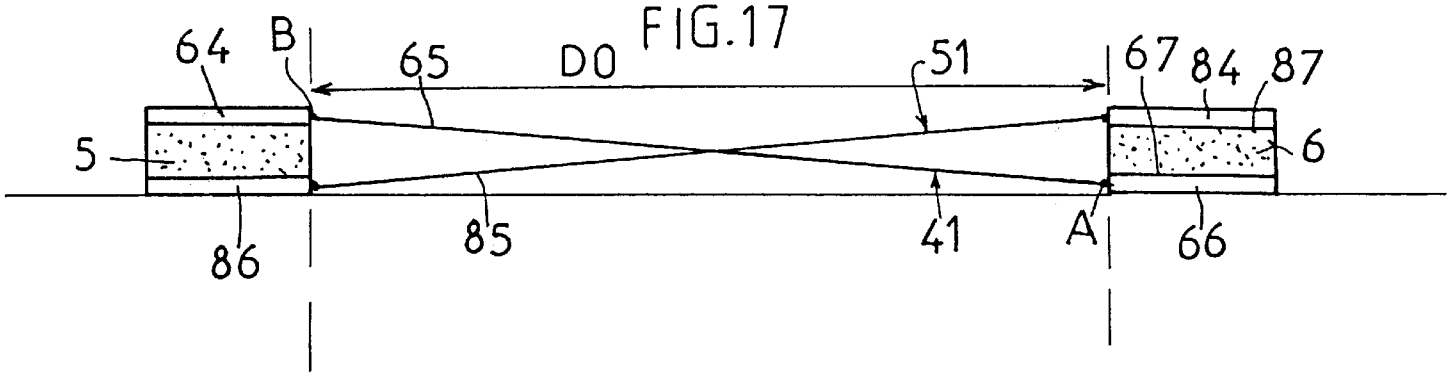
FIGS. 17 and 18 are geometrical diagrams showing the way in which the separation between the toe piece and the heel piece is maintained as the ski bends.
Figure 18:
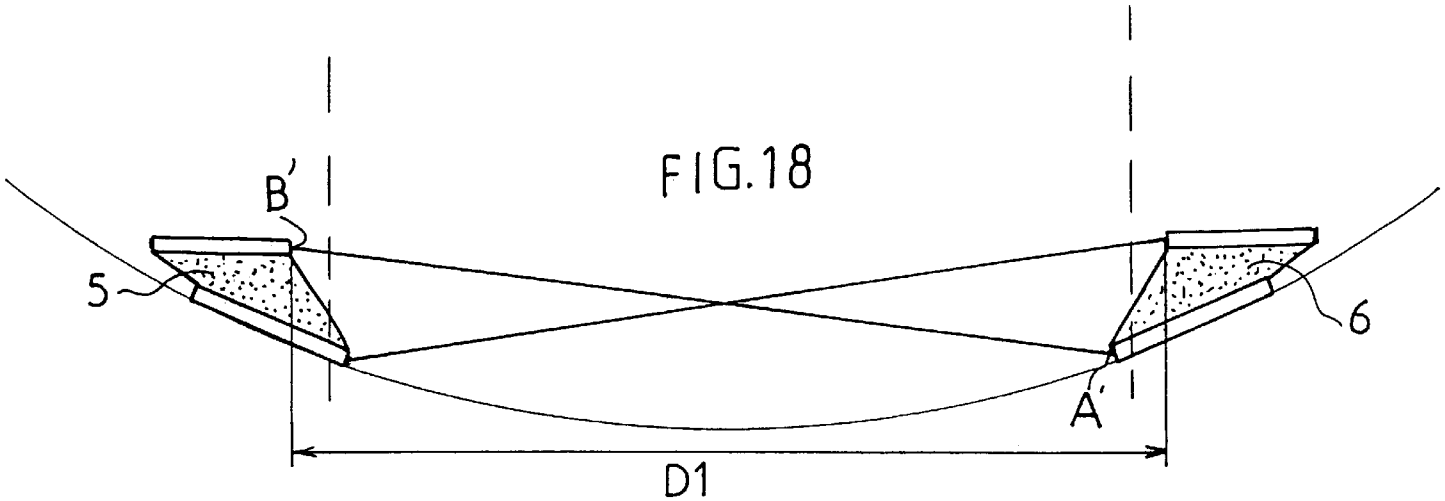

The mode of operation of the device, as well as its main advantage, are particularly clear when regarding FIGS. 17 and 18, which respectively represent, very schematically, the ski in its flat resting position and the deformation of the two viscoelastic blocks as the ski bends.

The case in question is that of advantageously using articulated arms (64, 65, 66, 67, 68) (see FIGS. 12 and 13) making it possible to combine shearing and compression of the viscoelastic blocks (5, 6). The performance of the assembly can be further improved by using viscoelastic blocks composed of two layers having enhanced capacities, respectively, for compression and for shearing.

The assembly formed by the two intermediate sections (43, 53) (49, 59) and the two viscoelastic blocks (5, 6) as described above, forms a deformable crossed quadrilateral whose opposite sides are pair-wise equal but not parallel. In FIGS. 17 and 18, A and B, and A' and B', respectively denote the bottom and top ends of one of the intermediate sections, representing the axes by which the sections are articulated to one another.

It is thus seen that, when the ski bends, the point A tends to move toward (A') the center of the support region. By virtue of the rigidity of the intermediate section (65), this results in the point B being pushed back (B') toward the exterior of the support region. Combination with the symmetrical effect of the other arm leads to the distance between the two top sections (64, 84) increasing slightly during bending. The maximum increase is typically approximately 2 millimeters.

In this way, and in contrast to all existing systems, the boot does not alter the rigidity of the ski and therefore does not interfere with the dynamic performance of the board. The slight increase in the distance between the toe piece and the heel piece (D1-D0) is taken up by the compensation springs provided in the heel piece. As is known, the bindings consist of an assembly of spring mechanisms which are set for a given separation between the toe piece (15) and the heel piece (16) when the board is flat.

This deformation of the board, and therefore of the raising device, causes an offset of the upper and lower faces of the viscoelastic block (5, 6). This deformation therefore results in the damping material being sheared, which makes it possible to absorb some portion of the deformation energy.

In addition, since the boot sole is very rigid, it tends to keep the top sections (64, 84) as closely aligned as possible. The force represented by the weight of the skier on his skis also causes the viscoelastic block (5, 6) to be compressed, and therefore an additional portion of the deformation energy to be absorbed.

Thus, when the ski bends, that is to say when the board assumes a curvature when passing through a hollow, or when turning, for example, the bottom sections (42, 52, 66, 86) of the two arms (51, 51) tend to move toward one another. By virtue of the rigidity of the central portions (43, 53, 65, 85) of the arms, the toe piece (15) and the heel piece (16) are mechanically moved apart from one another. The top sections (44, 54, 64, 84) of the arms therefore become shifted relative to the corresponding bottom sections (42, 52, 66, 86). This deformation is absorbed by each viscoelastic block (5, 6), which has its upper (87) and lower (67) faces moved in translation relative to one another. The shearing of the viscoelastic block (6) leads to the mechanical deformation energy being converted into heat.

In addition, the vibrations propagating along the board are also damped by the presence of the viscoelastic block, which is associated with the rigid plate to form a stress plate damper according to the known general principle.

It is thus clearly seen that the device according to the invention may include complementary damping systems, making it possible to use the relative movements of one arm with respect to the other, or more precisely of their intermediate sections, in order to absorb some of the deformation energy. In the variant illustrated in FIG. 14, it may prove advantageous to provide a friction element, for example a layer of viscoelastic material (78, 88), housed between the intermediate sections (61, 71, 62, 72) of each arm, with a device for adjusting the tightening through the apertures (69, 79).

Quite clearly, provision may be made to give the arms any shape which forms facing regions between which a layer of viscoelastic material is arranged, without departing from the scope of the invention.

In parallel, with an articulated device it is also possible to adjust the height of the bindings relative to the ski, simply by changing the height and/or nature of the viscoelastic blocks, which moreover makes it possible to adjust the degree of damping of the assembly.

As is shown in the above description, using the raising device according to the invention combines two significant advantages, namely the possibility of absorbing vibrations, while dissociating the rigidity of the boot from the stiffness of the ski during large-amplitude bending. This provides a ski which has good dynamic behavior in combination with a binding used with its optimum settings.

I claim:

1. A raising device for use with a ski having a top face and a support region, said device used to accommodate a safety binding formed at a front end by a toe piece and at a rear end by a heel piece, said raising device comprising:

a first opposing arm and a second opposing arm, said first opposing arm having a first bearing point located on the ski and a first floating end, said first floating end positioned in a raised position relative to the top face of the ski, said first floating end connected to the ski by a first viscoelastic block, said first block having a first upper face, said first upper face including means to accommodate the toe piece, said second opposing arm having a second bearing point located on the ski and a second floating end, said second floating end positioned in a raised position relative to the top face of the ski, said second floating end connected to the ski by a second viscoelastic block, said second block having a second upper face, said second upper face including means to accommodate the heel piece, wherein said first opposing arm and said second opposing arm partially overlap each other along a common longitudinal plane of the ski and wherein said first floating end is embedded substantially entirely within said first viscoelastic block; and, said second floating end is embedded substantially entirely within—said second viscoelastic block.

2. The raising device of claim 1 wherein said first bearing point comprises a first fork joint, said first fork joint fixed on the ski; and, said second bearing point comprises a second fork joint, said second fork joint fixed on the ski.

3. The raising device of claim 1 wherein said first opposing arm further comprises a plate, said plate substantially parallel to said first upper face, said plate embedded inside said first viscoelastic block.

4. The raising device of claim 1 wherein said second opposing arm further comprises a plate, said plate substantially parallel to said second upper face, said plate embedded inside said second viscoelastic block.

5. The raising device of claim 1 wherein said first opposing arm further comprises a plate, said plate substantially parallel to said first upper face, said plate embedded inside said first viscoelastic block; and, said second opposing arm further comprises a plate, said plate substantially parallel to said second upper face, said plate embedded inside said second viscoelastic block.

6. The raising device of claim 1 wherein:

said first viscoelastic block and said second viscoelastic block have an intrinsic damping coefficient between 0.4 and 1.2.

7. The raising device of claim 1 wherein:

said first opposing arm and said second opposing arm are between 2 mm and 10 mm in width.

8. The raising device of claim 1 wherein:

said first viscoelastic block and said second viscoelastic are between 3 mm and 50 mm in thickness.

9. A raising device for use with a ski having a top face, side faces, and a support region, said device used to accommodate a safety binding formed at a front end by a toe piece and at a rear end by a heel piece, said raising device comprising:

a first opposing arm and a second opposing arm, said first opposing arm including a first bottom section comprising a first bearing point located on the ski, a first top section comprising a first floating end, said first floating end positioned in a raised position relative to the top face of the ski, said first floating end connected to the ski by a first viscoelastic block, said first block having a first upper face, said first upper face including means to accommodate the toe piece, and, a first intermediate section connecting said first top section and said first bottom section, said second opposing arm including a second bottom section comprising a second bearing point located on the ski, a second top section comprising a second floating end, said second floating end positioned in a raised position relative to the top face of the ski, said second floating end connected to the ski by a second viscoelastic block, said second block having a second upper face, said second upper face including means to accommodate the toe piece, and, a second intermediate section connecting said second top section and said second bottom section, wherein said first opposing arm and said second opposing arm partially overlap each other along a common longitudinal plane of the ski, and further wherein— said first intermediate section has a first section of reduced width; and, said second intermediate section has a second section of reduced width, whereby said first intermediate section and said second intermediate section intercross.

10. A raising device for use with a ski having a top face, side faces, and a support region, said device used to accommodate a safety binding formed at a front end by a toe piece and at a rear end by a heel piece, said raising device comprising:

a first opposing arm and a second opposing arm, said first opposing arm including a first bottom section comprising a first bearing point located on the ski, a first top section comprising a first floating end, said first floating end positioned in a raised position relative to the top face of the ski, said first floating end connected to the ski by a first viscoelastic block, said first block having a first upper face, said first upper face including means to accommodate the toe piece, and, a first intermediate section connecting said first top section and said first bottom section, said second opposing arm including a second bottom section comprising a second bearing point located on the ski, a second top section comprising a second floating end, said second floating end positioned in a raised position relative to the top face of the ski, said second floating end connected to the ski by a second viscoelastic block, said second block having a second upper face, said second upper face including means to accommodate the toe piece, and, a second intermediate section connecting said second top section and said second bottom section, wherein said first opposing arm and said second opposing arm partially overlap each other along a common longitudinal plane of the ski, and further wherein said first intermediate section and said second intermediate section are connected by a joint, and— said joint comprises viscoelastic material.

11. A raising device for use with a ski having a top face, side faces, and a support region, said device used to accommodate a safety binding formed at a front end by a toe piece and at a rear end by a heel piece, said raising device comprising:

a first opposing arm and a second opposing arm, said first opposing arm including a first bottom section comprising a first bearing point located on the ski, a first top section comprising a first floating end, said first floating end positioned in a raised position relative to the top face of the ski, said first floating end connected to the ski by a first viscoelastic block, said first block having a first upper face, said first upper face including means to accommodate the toe piece, and, a first intermediate section connecting said first top section and said first bottom section, said second opposing arm including a second bottom section comprising a second bearing point located on the ski, a second top section comprising a second floating end, said second floating end positioned in a raised position relative to the top face of the ski, said second floating end connected to the ski by a second viscoelastic block, said second block having a second upper face, said second upper face including means to accommodate the toe piece, and, a second intermediate section connecting said second top section and said second bottom section, wherein said first opposing arm and said second opposing arm partially overlap each other along a common longitudinal plane of the ski, and further wherein— said first viscoelastic block and said second viscoelastic block have an intrinsic damping coefficient between 0.4 and 1.2.

12. A raising device for use with a ski having a top face, side faces, and a support region, said device used to accommodate a safety binding formed at a front end by a toe piece and at a rear end by a heel piece, said raising device comprising:

a first opposing arm and a second opposing arm, said first opposing arm including a first bottom section comprising a first bearing point located on the ski, a first top section comprising a first floating end, said first floating end positioned in a raised position relative to the top face of the ski, said first floating end connected to the ski by a first viscoelastic block, said first block having a first upper face, said first upper face including means to accommodate the toe piece, and, a first intermediate section connecting said first top section and said first bottom section, said second opposing arm including a second bottom section comprising a second bearing point located on the ski, a second top section comprising a second floating end, said second floating end positioned in a raised position relative to the top face of the ski, said second floating end connected to the ski by a second viscoelastic block, said second block having a second upper face, said second upper face including means to accommodate the toe piece, and, a second intermediate section connecting said second top section and said second bottom section, wherein said first opposing arm and said second opposing arm partially overlap each other along a common longitudinal plane of the ski, and further wherein— said first opposing arm and said second opposing arm are between 2 mm and 10 mm in width.

13. A raising device for use with a ski having a top face, side faces, and a support region, said device used to accommodate a safety binding formed at a front end by a toe piece and at a rear end by a heel piece, said raising device comprising:

a first opposing arm and a second opposing arm, said first opposing arm including a first bottom section comprising a first bearing point located on the ski, a first top section comprising a first floating end, said first floating end positioned in a raised position relative to the top face of the ski, said first floating end connected to the ski by a first viscoelastic block, said first block having a first upper face, said first upper face including means to accommodate the toe piece, and, a first intermediate section connecting said first top section and said first bottom section, said second opposing arm including a second bottom section comprising a second bearing point located on the ski, a second top section comprising a second floating end, said second floating end positioned in a raised position relative to the top face of the ski, said second floating end connected to the ski by a second viscoelastic block, said second block having a second upper face, said second upper face including means to accommodate the toe piece, and, a second intermediate section connecting said second top section and said second bottom section, wherein said first opposing arm and said second opposing arm partially overlap each other along a common longitudinal plane of the ski, and further wherein— said first viscoelastic block and said second viscoelastic are between 3 mm and 50 mm in thickness.

* * * * *